US011117775B2

(12) United States Patent
Choi

(10) Patent No.: US 11,117,775 B2
(45) Date of Patent: Sep. 14, 2021

(54) CUTTING APPARATUS FOR ROLL ZEBRA BLIND

(71) Applicant: BMO Inc., Busan (KR)

(72) Inventor: Kyu Su Choi, Busan (KR)

(73) Assignee: BMO INC., Busan (KR)

( * ) Notice: Subject to any disclaimer, the term of this patent is extended or adjusted under 35 U.S.C. 154(b) by 0 days.

(21) Appl. No.: 16/678,325

(22) Filed: Nov. 8, 2019

(65) Prior Publication Data

US 2021/0053788 A1 Feb. 25, 2021

(30) Foreign Application Priority Data

Aug. 22, 2019 (KR) ..... 10-2019-0102921

(51) Int. Cl.

| | |
|---|---|
| ***B65H 35/02*** | (2006.01) |
| ***B65H 35/04*** | (2006.01) |
| ***B65H 35/00*** | (2006.01) |
| ***B65H 19/28*** | (2006.01) |

(52) U.S. Cl.

CPC ..... *B65H 35/0086* (2013.01); *B65H 19/283* (2013.01); *B65H 35/0093* (2013.01); *B65H 35/02* (2013.01); *B65H 35/04* (2013.01)

(58) Field of Classification Search

CPC .... B65H 35/04; B65H 35/02; B65H 35/0086; B65H 19/283; B26D 2011/005

USPC ..... 83/520–521, 363, 369, 408, 109–159; 242/532.3, 583

See application file for complete search history.

(56) References Cited

U.S. PATENT DOCUMENTS

| | | | | |
|---|---|---|---|---|
| 3,620,114 | A * | 11/1971 | Chudyk | D06H 7/00 83/107 |
| 3,691,140 | A | 9/1972 | Silver | |
| 3,977,627 | A * | 8/1976 | Sundin | B65H 18/20 242/525.2 |
| 4,645,783 | A | 2/1987 | Kinoshita | |
| 4,656,218 | A | 4/1987 | Kinoshita | |
| 5,383,622 | A * | 1/1995 | Kohler | B65H 19/283 242/527.2 |
| 5,502,108 | A | 3/1996 | Silver et al. | |

(Continued)

FOREIGN PATENT DOCUMENTS

| | | | |
|---|---|---|---|
| JP | 03124851 | A * | 5/1991 |
| JP | H05-148741 | A | 6/1993 |

(Continued)

OTHER PUBLICATIONS

Translation of JP-03124851-A (Year: 1991).*

Korean Office Action for related KR Application No. 10-2019-0102921 dated Oct. 16, 2020 from Korean Intellectual Property Office.

(Continued)

*Primary Examiner* — Kenneth E Peterson

(74) *Attorney, Agent, or Firm* — Paratus Law Group, PLLC

(57) ABSTRACT

Disclosed is a cutting apparatus for a roll zebra. The cutting apparatus includes: a main body portion; a mounting portion provided at one side of the main body portion to wind or unwind a fabric; a cutting portion provided at one side of the main body portion to cut the fabric with a required length; and a discharge portion provided at one side of the main body portion to convey the fabric cut by the cutting portion to the outside. The cutting portion includes a longitudinal cutting portion cutting the fabric in a longitudinal direction, and a transverse cutting portion cutting the fabric in a transverse direction.

2 Claims, 7 Drawing Sheets

(56) References Cited

U.S. PATENT DOCUMENTS

| | | | | |
|---|---|---|---|---|
| 6,606,929 | B2 * | 8/2003 | Evreniadis | B26D 1/025 83/167 |
| 7,887,003 | B2 * | 2/2011 | Maddaleni | B65H 19/267 242/532.3 |
| 2001/0045148 | A1 * | 11/2001 | Gerent | B26D 5/007 83/49 |
| 2002/0088323 | A1 * | 7/2002 | Hashigaya | B26D 5/40 83/38 |
| 2003/0047638 | A1 * | 3/2003 | Shinohara | B65H 19/28 242/532.3 |
| 2003/0131704 | A1 * | 7/2003 | Villacis | B26D 7/015 83/520 |
| 2021/0053087 | A1 | 2/2021 | Agostini | |

FOREIGN PATENT DOCUMENTS

| | | | |
|---|---|---|---|
| KR | 10-0845550 | B1 | 7/2008 |
| KR | 10-2010-0044642 | A | 4/2010 |
| KR | 10-1654728 | B1 | 9/2016 |
| KR | 10-2017-0142422 | A | 12/2017 |
| KR | 10-1898335 | B1 | 9/2018 |
| WO | WO 2019/154626 | A1 | 8/2019 |

OTHER PUBLICATIONS

International Search Report for PCT/KR2020/008774 dated Oct. 23, 2020 from Korean Intellectual Property Office.

Written Opinion of the International Searching Authority for PCT/KR2020/008774 dated Oct. 23, 2020 from Korean Intellectual Property Office.

* cited by examiner

CUTTING APPARATUS FOR ROLL ZEBRA BLIND

CROSS REFERENCE TO RELATED APPLICATION

This application claims priority to Korean Patent Application No. 10-2019-0102921 filed on Aug. 22, 2019, which is hereby incorporated by reference in its entirety.

BACKGROUND

The present invention relates to a cutting apparatus for a roll zebra blind and more particularly, to a cutting apparatus for a roll zebra blind capable of performing longitudinal cutting and transverse cutting in sequence to more enhance accuracy of the cutting.

A fabric manufacturing process includes a design process of determining a design and forming a predetermined pattern on a fabric by a method such as drawing or printing, a fabric cutting process of cutting the fabric according to a pattern formed on the fabric, and a fabric sewing process of sewing the cut fabric.

Among them, the fabric cutting process is a process of cutting fabrics according to patterns by laminating a plurality of fabrics formed with the patterns. At this time, for the fabric cutting process, a cutting apparatus is used. The cutting apparatus cuts the fabrics using a laser, a cutter blade, etc.

Meanwhile, with respect to a conventional cutting apparatus, in order to cut and separate a fabric at regular intervals without an error, there is an apparatus including a weaving machine of weaving the fabric, a frame including a cutting table, and a band cutter of cutting the fabric horizontally. When using such an apparatus, the laminated fabrics may be scattered by the stress applied from the band cutter at the cutting process for a plurality of the laminated fabrics. Accordingly, there is a problem in that accurate cutting for the fabrics is difficult. Particularly, in the case of a blind formed by crossing portions for blocking the sunlight and translucent portions for partially transmitting the sunlight, accurate cutting is required.

In the related art, in order to solve the problems, in Korean Patent Registration No. 10-1898335 (Sep. 12, 2018), there is disclosed an apparatus for manufacturing a roll blind capable of automatically manufacturing a roll blind.

However, in order to cut the fabric in a longitudinal direction and a transverse direction, a wide space is necessarily required. In order to perform the longitudinal cutting and the transverse cutting, after the longitudinal cutting, an operator recovers the cut fabrics and then cuts the fabrics in the transverse direction again, so that there is also a problem in that the fabrics may be distorted and an operation time is also required twice.

PRIOR ART DOCUMENT

Patent Document (Patent Document 1) Korean Patent Registration No. 10-1898335 (Sep. 12, 2018)

SUMMARY

Therefore, the present invention is derived to solve the problems of the related art, and an object of the present invention is to provide a cutting apparatus for a roll zebra blind which may perform longitudinal cutting and transverse cutting in sequence to more enhance accuracy of the cutting and reduce remarkably a space required for performing the longitudinal cutting and the transverse cutting as compared with a conventional cutting apparatus.

Objects to be solved by the present invention are not limited to the aforementioned objects and other unmentioned objects to be solved by the present invention will be clearly understood by those skilled in the art from the following description.

According to a preferred embodiment of the present invention, there is provided a cutting apparatus for a roll zebra blind comprising: a main body portion; a mounting portion provided at one side of the main body portion to wind or unwind a fabric; a cutting portion provided at one side of the main body portion to cut the fabric with a required length; and a discharge portion provided at one side of the main body portion to convey the fabric cut by the cutting portion to the outside, wherein the cutting portion includes longitudinal cutting portion cutting the fabric in a longitudinal direction; and transverse cutting portion cutting the fabric in a transverse direction.

The mounting portion may include a laser portion emitting laser light indicating a point where the fabric is placed, wherein the laser portion may guide an operator to check an original point of the fabric.

The discharge portion may include two rolling portions rotating independently, wherein the two rolling portions may rotate in the same direction to wind the fabric cut by the cutting portion.

The discharge portion may further include a punch portion which applies an external force to the fabric cut by the cutting portion so that the fabric falls down to be moved to the two rolling portions.

The main body portion may include a sensor measuring a length at which the fabric is inserted into the main body portion.

According to the present invention, the cutting apparatus for the roll zebra blind may perform the longitudinal cutting and the transverse cutting of the fabric in sequence to more enhance the precision of the cutting and automatically perform the cutting of the fabric to improve workability.

Further, the cutting apparatus for the roll zebra blind has an effect of performing more precise cutting by aligning an original point of the longitudinal cutting of the fabric using the laser light.

Further, the cutting apparatus for the roll zebra blind has an effect of performing precise cutting by counting the moving number of nets and solids based on one of the net and the solid when cutting the fabric consisting of the nets and the solids to measure a length at which the fabric is inserted.

Further, the cutting apparatus for the roll zebra blind has an effect of reducing a space required for performing the longitudinal cutting and the transverse cutting of the fabric by the cutting apparatus and reducing a time wasted by cutting the longitudinal cutting and then cutting the fabric in a transverse direction again after the operator recovers the cut fabric.

Further, the cutting apparatus for the roll zebra blind has an effect of improving the quality of the fabric by preventing the fabric from being disordered or misaligned until the longitudinal cutting and the transverse cutting are completed.

DETAILED DESCRIPTION

Terms used in the present specification will be described in brief and the present invention will be described in detail.

Terms used in the present invention adopt general terms which are currently widely used as possible by considering functions in the present invention, but the terms may be changed depending on an intention of those skilled in the art, a precedent, emergence of new technology, etc. Accordingly, a term used in the present invention should be defined based on not just a name of the term but a meaning of the term and contents throughout the present invention.

Further, throughout the specification, unless explicitly described to the contrary, the word "comprise" and variations such as "comprises" or "comprising", will be understood to imply the inclusion of stated elements but not the exclusion of any other elements.

An exemplary embodiment of the present invention will be described more fully hereinafter with reference to the accompanying drawings so as to be easily implemented by those skilled in the art. However, the present invention may be embodied in many different forms and are limited to embodiments described herein.

Specific matters including problems to be solved for the present invention, solutions of the problems, and the effects of the invention for the present invention are included in exemplary embodiments and drawings to be described below. Advantages and features of the present invention, and methods for accomplishing the same will be more clearly understood from embodiments described in detail below with reference to the accompanying drawings.

Hereinafter, the present invention will be described in more detail with reference to the accompanying drawings.

Figure 1:
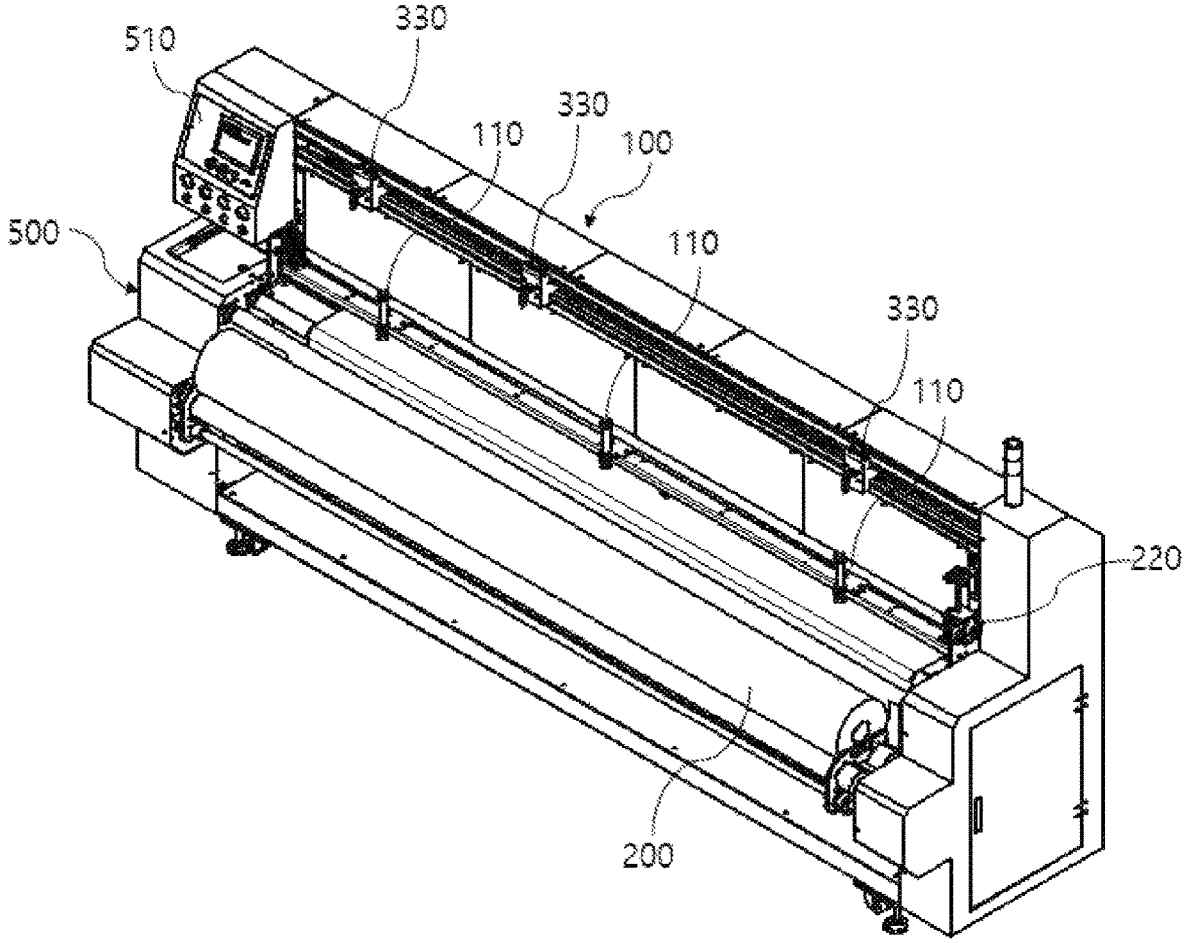
FIG. 1 is a perspective view illustrating a configuration of a cutting apparatus for a roll zebra blind according to a preferred embodiment of the present invention.
Figure 2:
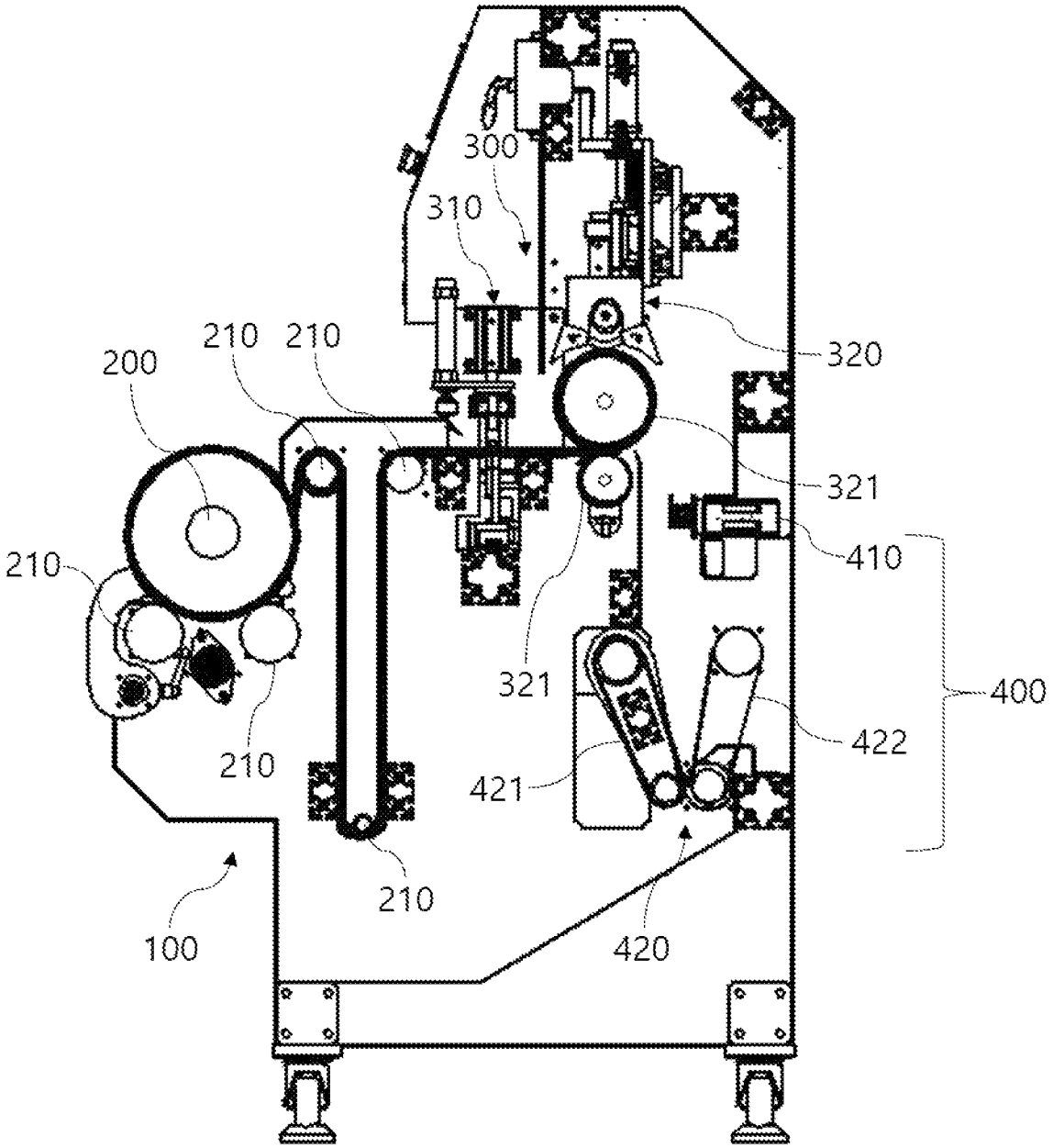
FIG. 2 is a view illustrating a lateral cross section of the cutting apparatus for the roll zebra blind according to the preferred embodiment of the present invention.

In a cutting apparatus for a roll zebra blind according to a preferred embodiment of the present invention, referring to FIGS. 1 and 2, the cutting apparatus includes a main body portion 100, a mounting portion 200 provided at one side of the main body portion 100 to wind or unwind a fabric, a cutting portion 300 provided at one side of the main body portion 100 to cut the fabric with required lengths, and a discharge portion provided at one side of the main body portion 100 to convey the fabric cut by the cutting portion 300 to the outside. The cutting portion 300 includes longitudinal cutting portion 310 cutting the fabric in a longitudinal direction and transverse cutting portion 320 cutting the fabric in a transverse direction.

First, the main body portion 100 is provided. The main body portion 100 supports configurations such as the mounting portion 200, the cutting portion 400, and the discharge portion 400 and serves to prevent safety accidents which may occur due to an internal operation. Further, the main body portion 100 is formed to extend in a longitudinal direction and provided to accommodate a wide fabric.

Next, the main body portion 100 includes a sensor (not illustrated) measuring a length at which the fabric is inserted into the main body portion 100. More particularly, a plurality of sensors may be provided at a portion where the fabric is inserted into the main body portion 100.

At this time, the fabric may be provided in a form in which portions for blocking the sunlight and translucent portions capable of partially transmitting the sunlight are continuously repeated. That is, the fabric is formed with nets as the translucent portions and solids as opaque portions which have the same lengths. Accordingly, as the fabric is unwound, the sensor may count the moving number based on one of the net and the solid to measure a length at which the fabric is inserted into the main body portion 100. That is, the sensor may measure the length at which the fabric is inserted into the main body portion 100 using the number of nets which are inserted into the main body portion 100 and a length of one space of the net.

For example, a controller 500 is provided at an upper left end of the main body portion 100, and the controller 500 includes a display portion 510 provided so that the operator may input a desired length of the fabric. Accordingly, when the operator input a required length of the fabric to the display portion 510, the controller 500 controls the fabric having the required length to be unwound to the cutting portion 300 according to an input value.

Further, the main body portion 100 includes a plurality of cylinders 110 for preventing the fabric from falling down after the longitudinal cutting of the fabric. The cylinders are spaced apart from each other at regular intervals at a point where the fabric is inserted into the main body portion 100 and provided in parallel in a width direction of the fabric. In addition, the cylinders 110 serve to fix the fabric when the longitudinal cutting portion 310 cuts the fabric. That is, the longitudinal cutting portion 310 serves to cut the fabric or prevent the fabric from being disordered or falling down to be deviated from an original point after cutting.

Next, the mounting portion 200 is provided. The mounting portion 200 is provided on a front surface of the main body portion 100 and maximally elongated in a longitudinal direction of the main body portion 100. Further, the mounting portion 200 is formed to be elongated in a longitudinal direction and provided to accommodate a wide fabric like the main body portion 100. The mounting portion 200 serves to unwind or wind the fabric and may include a driving module (not illustrated) which is on/off by the controller 500 and provides power to the mounting portion 200.

Further, the mounting portion 200 includes a laser portion 220 emitting laser light representing a point where the fabric is placed and the laser portion 220 guides the operator to check the original point of the fabric. More particularly, the laser portions 220 are provided at both sides of the main body portion 110 to radiate the laser light toward the point where the fabric is inserted into the main body portion 100. The laser light becomes an original point in the longitudinal direction of the fabric. That is, the operator sets the length of the fabric based on the laser light. As a result, the laser portion 220 provides a reference point for the longitudinal cutting of the fabric to more precisely perform the cutting.

Further, the laser portion 220 guides the fabric to be supplied to the cutting portion 300 horizontally. That is, the laser portion 220 serves to guide the fabric to be unwound to the cutting portion 300 while the fabric is flat without disordering or wrinkling into the main body portion 100.

For example, the operator allows the fabric to be unwound into the main body portion 100 according to laser light emitted from the laser portion 220. Further, when the laser light is interfered or bent, the operator may determine a state where the fabric is disordered or wrinkled at a glance to stop the operation of the controller 500 and align the fabric, so that there are advantages of minimizing defects from occurring.

Further, the mounting portion 200 includes a plurality of guide portions 210 for guiding the movement of the fabric so that the fabric may be unwound to the cutting portion 300. That is, the guide portions 210 may guide the fabric to be moved to the cutting portion 300 while the fabric is flat without disordering or wrinkling and may perform more precise cutting so that the fabric is not shaken even when the cutting portion 300 cuts the fabric.

Next, the cutting portion 300 is provided. The cutting portion 300 includes a plurality of longitudinal cutting portions 310 cutting the fabric in a longitudinal direction and a plurality of transverse cutting portions 320 cutting the fabric in a transverse direction. More particularly, the longitudinal cutting portions 310 are formed to be elongated in a longitudinal direction and provided to cut rapidly a wide fabric, like the main body portion 100 and the mounting portion 200. Further, the transverse cutting portions 320 include two loading portions 321 winding or unwinding the fabric. The two loading portions 321 are disposed at upper and lower portions based on the fabric, respectively, and rotate in opposite directions to each other to wind the fabric. That is, the transverse cutting portions 320 may rapidly cut the fabric in a transverse direction while the fabric is wound and rotate on the loading portion 321 located on the upper portion.

Further, a convey portion 330 for varying a location of the transverse cutting portions 320 is provided at the upper side of the main body portion 100. The plurality of convey portions 330 are formed and provided to convey the plurality of transverse cutting portions 320, respectively, to cut selectively a width of the fabric if necessary.

Next, the discharge portion 400 is provided. The discharge portion 400 is provided below the cutting portion 300 to discharge the fabric cut by the cutting portion 300 to the outside of the main body portion 100.

Further, the discharge portion 400 includes two rolling portions 420 rotating independently and the two rolling portions 420 rotate in the same direction to wind the fabric cut by the cutting portion 300. That is, after the fabric cut by the cutting portion 300 descends between the two rolling portions 420, the two rolling portions 420 rotate in the same direction to wind the fabric cut by the cutting portion 300.

Further, the discharge portion 400 further includes a punch portion 410 which applies an external force to the fabric cut by the cutting portion 300 to allow the fabric to fall down and then move to the two rolling portions 420. More particularly, a bonding portion (not shown) is provided at a part of an outer peripheral surface of the loading portion 321 so that the end of the fabric may be wound on the loading portion 321. That is, first, the fabric is unwound to the cutting portion 300 to be in contact with the outer peripheral surface of the loading portion 321 provided with the bonding portion, and the fabric may be rolled and wound on the loading portion 321 due to the bonding portion. Accordingly, after the fabric is cut with required width and length, the punch portion 410 applies the external force to the fabric so that the fabric descends to the rolling portion 420 and then the fabric may be separated from the bonding portion. The bonding portion may be formed in any form as long as the fabric may have a bonding force enough to be wound on the loading portion 321.

Hereinafter, an operation sequence of the cutting apparatus for the roll zebra blind of the present invention having the configuration will be described with reference to FIGS. 3 to 7.

Figure 3:
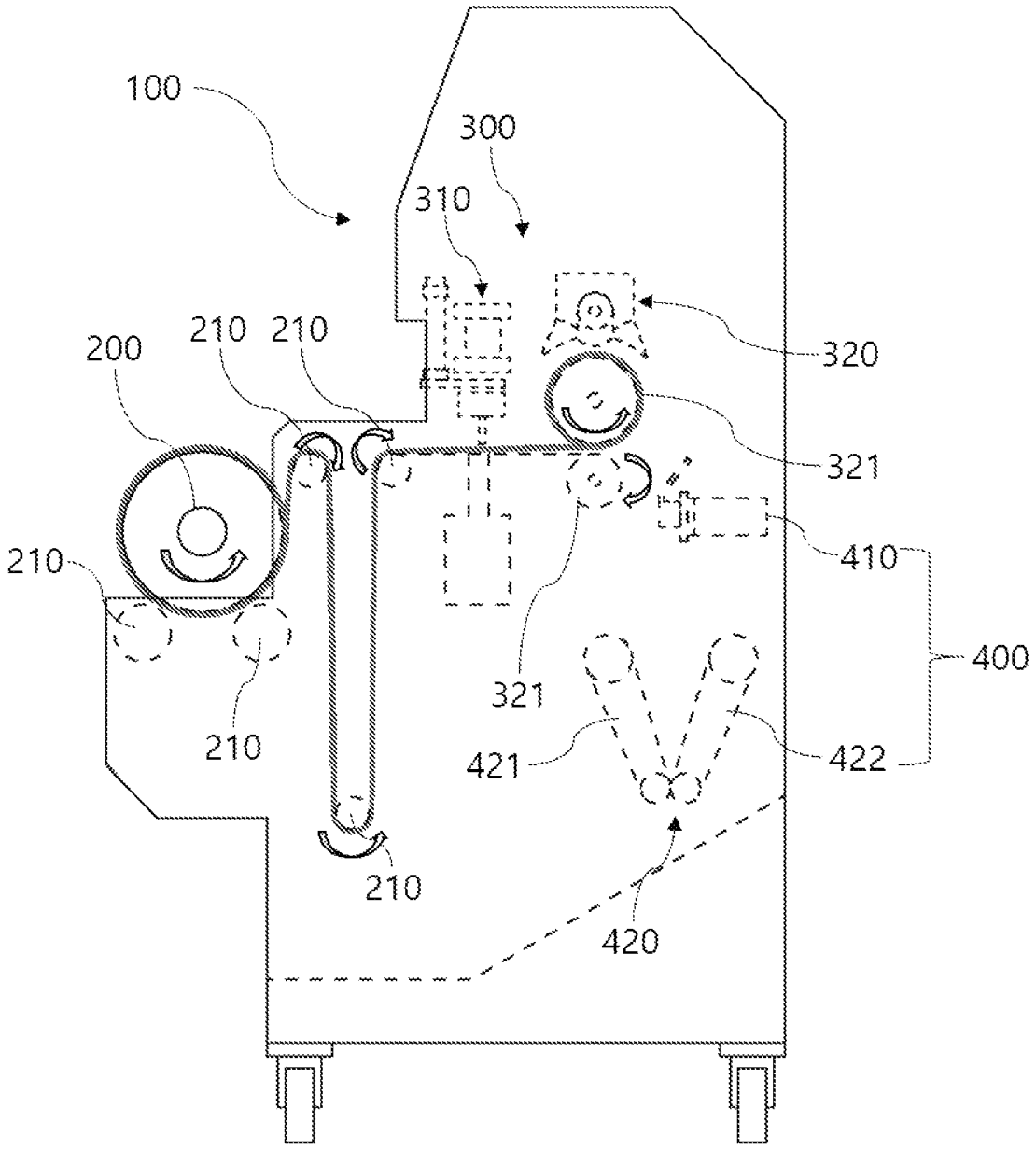
FIG. 3 is a view illustrating an operation sequence of the cutting apparatus for the roll zebra blind according to the preferred embodiment of the present invention.

First, referring to FIG. 3, the operator inputs required length and width of the fabric to the display portion 510 and the controller 500 shows the state that the fabric is unwound based on the input information. At this time, a reference point of the input length is an end of the longitudinal cutting portion 310.

Figure 4:
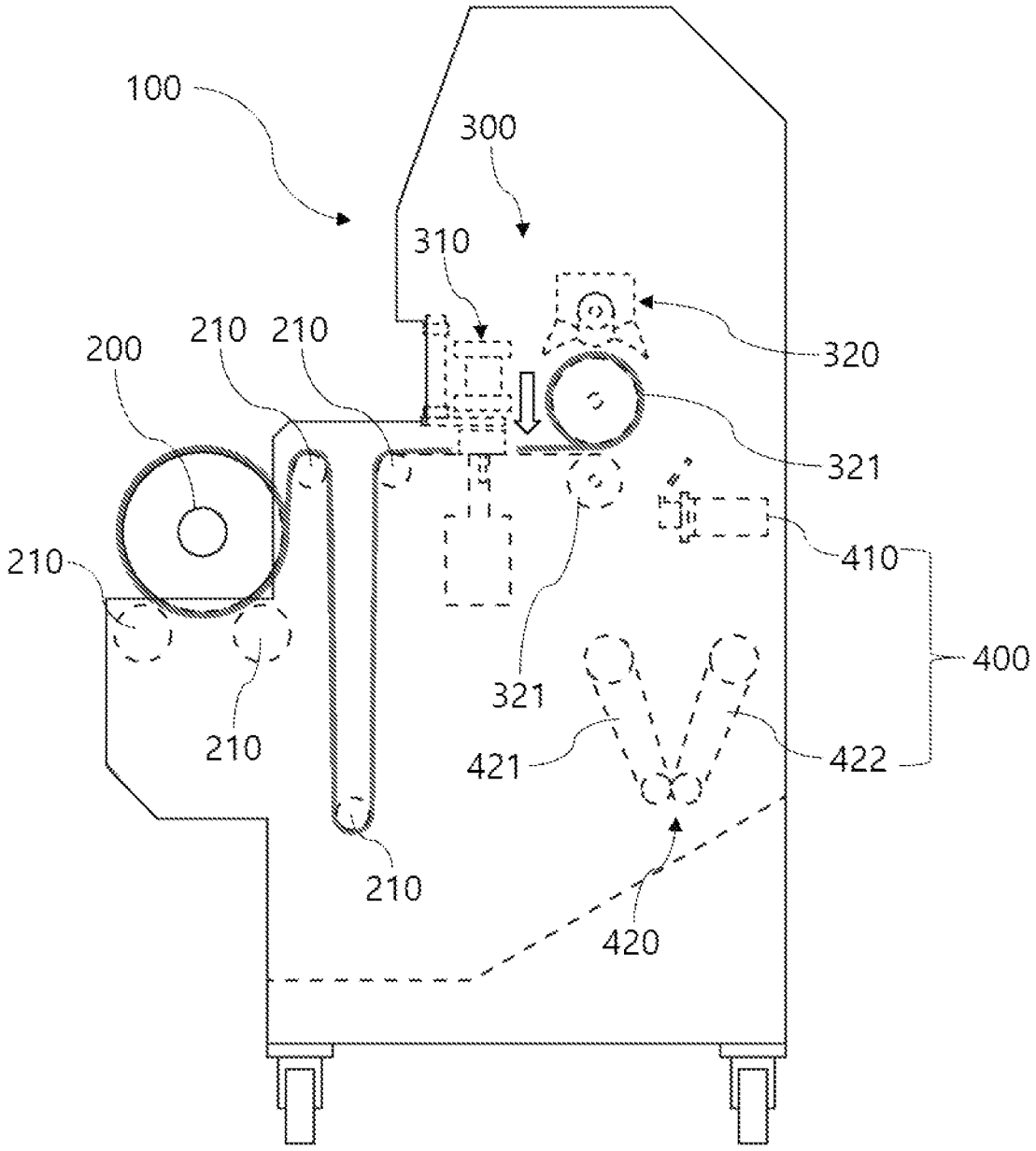
FIG. 4 is a view illustrating an operation sequence of the cutting apparatus for the roll zebra blind according to the preferred embodiment of the present invention.

Thereafter, referring to FIG. 4, while the fabric stops, the longitudinal cutting portion 310 descends to cut the fabric in a longitudinal direction.

Figure 5:
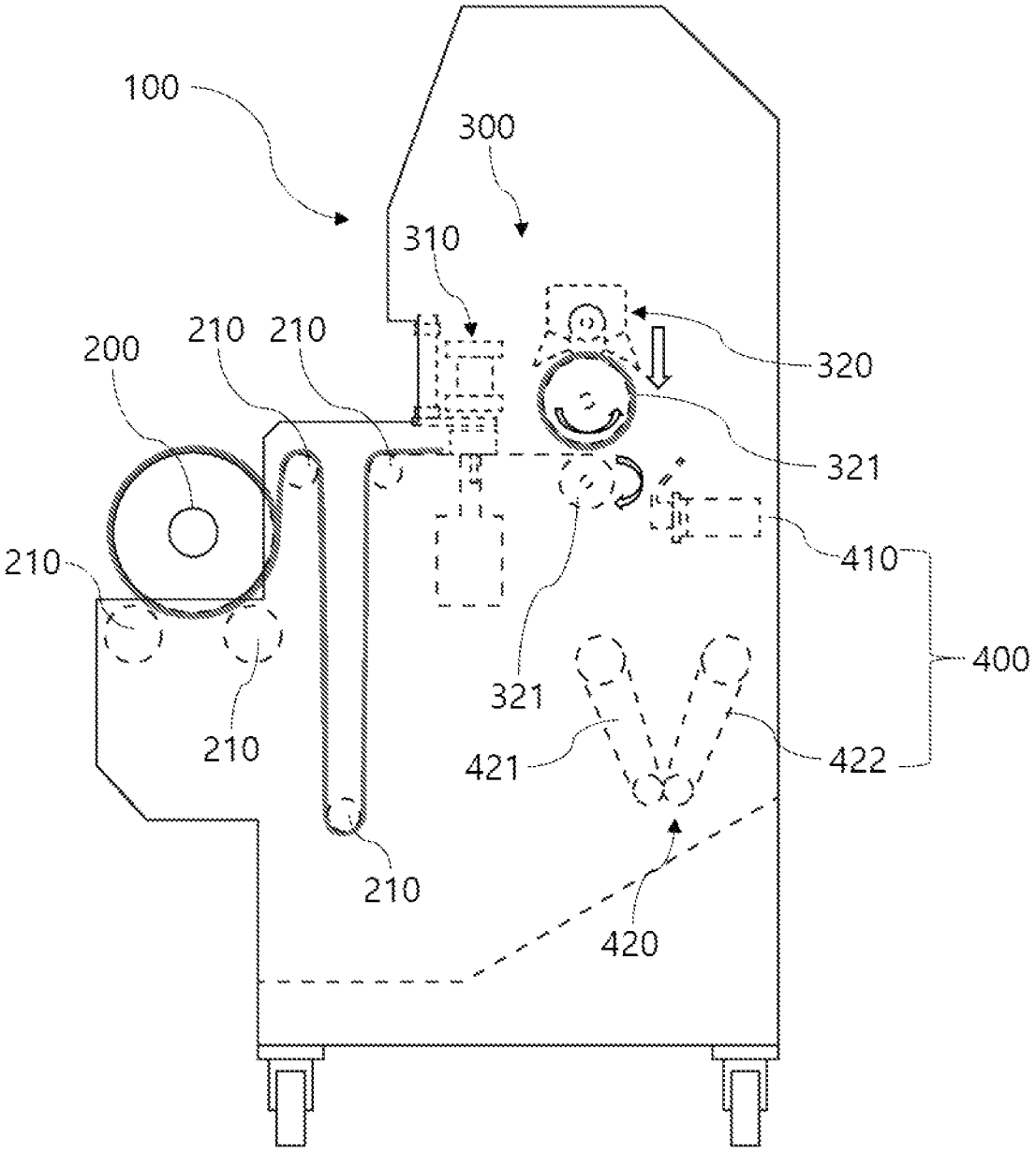
FIG. 5 is a view illustrating an operation sequence of the cutting apparatus for the roll zebra blind according to the preferred embodiment of the present invention.

Next, referring to FIG. 5, while the fabric rotates by the loading portion 321, the transverse cutting portion 320 descends to cut the fabric in a transverse direction.

Figure 6:
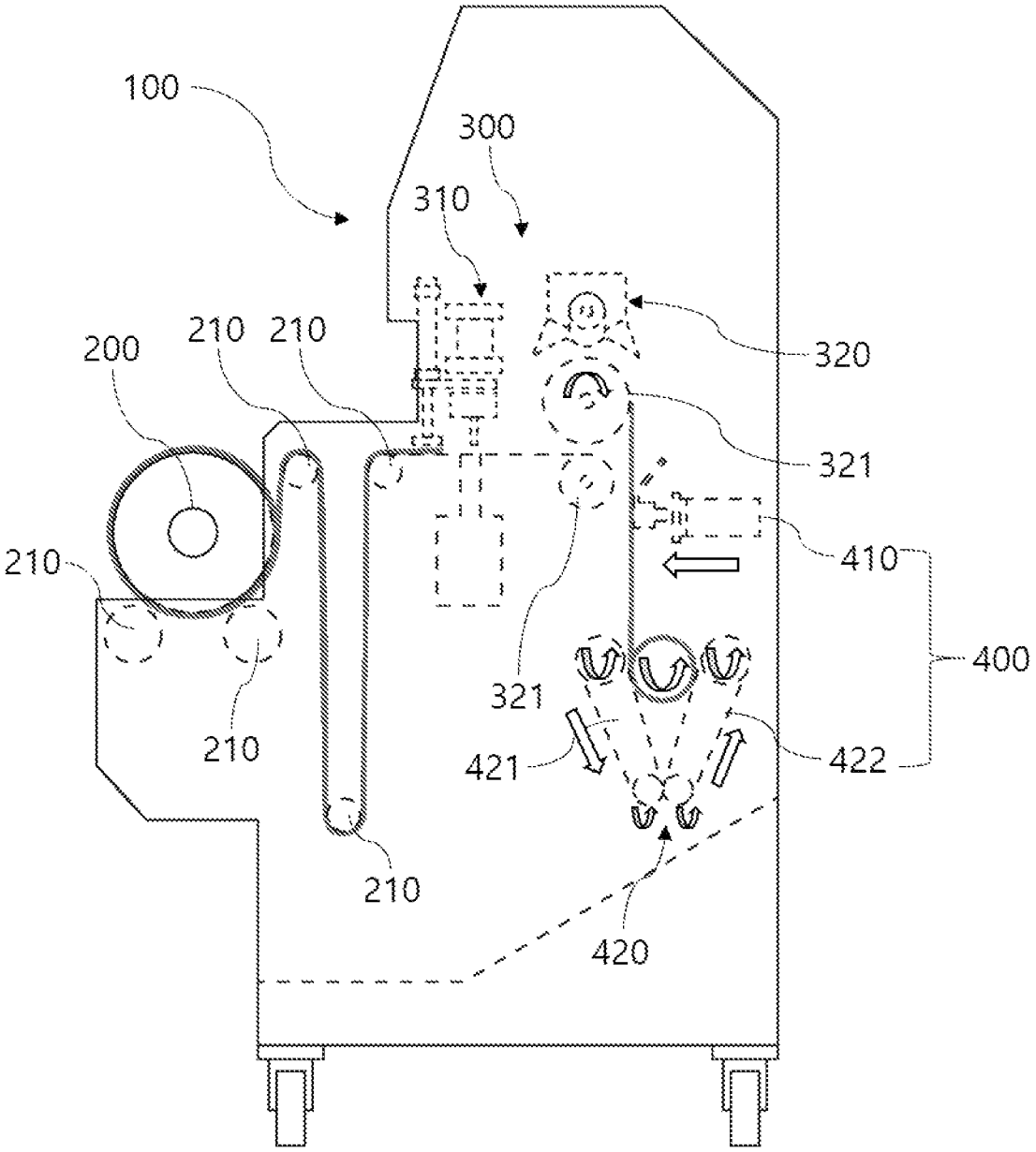
FIG. 6 is a view illustrating an operation sequence of the cutting apparatus for the roll zebra blind according to the preferred embodiment of the present invention.

Next, referring to FIG. 6, the fabric cut by the cutting portion 300 falls down to the rolling portion 420. At this time, the punch portion 410 applies the external force to the fabric so that the cut fabric may fall down to the rolling portion 420. Further, the first rolling portion 421 and the second rolling portion 422 rotate in the same direction to unwind the fabric falling down between the first rolling portion 421 and the second rolling portion 422.

Figure 7:
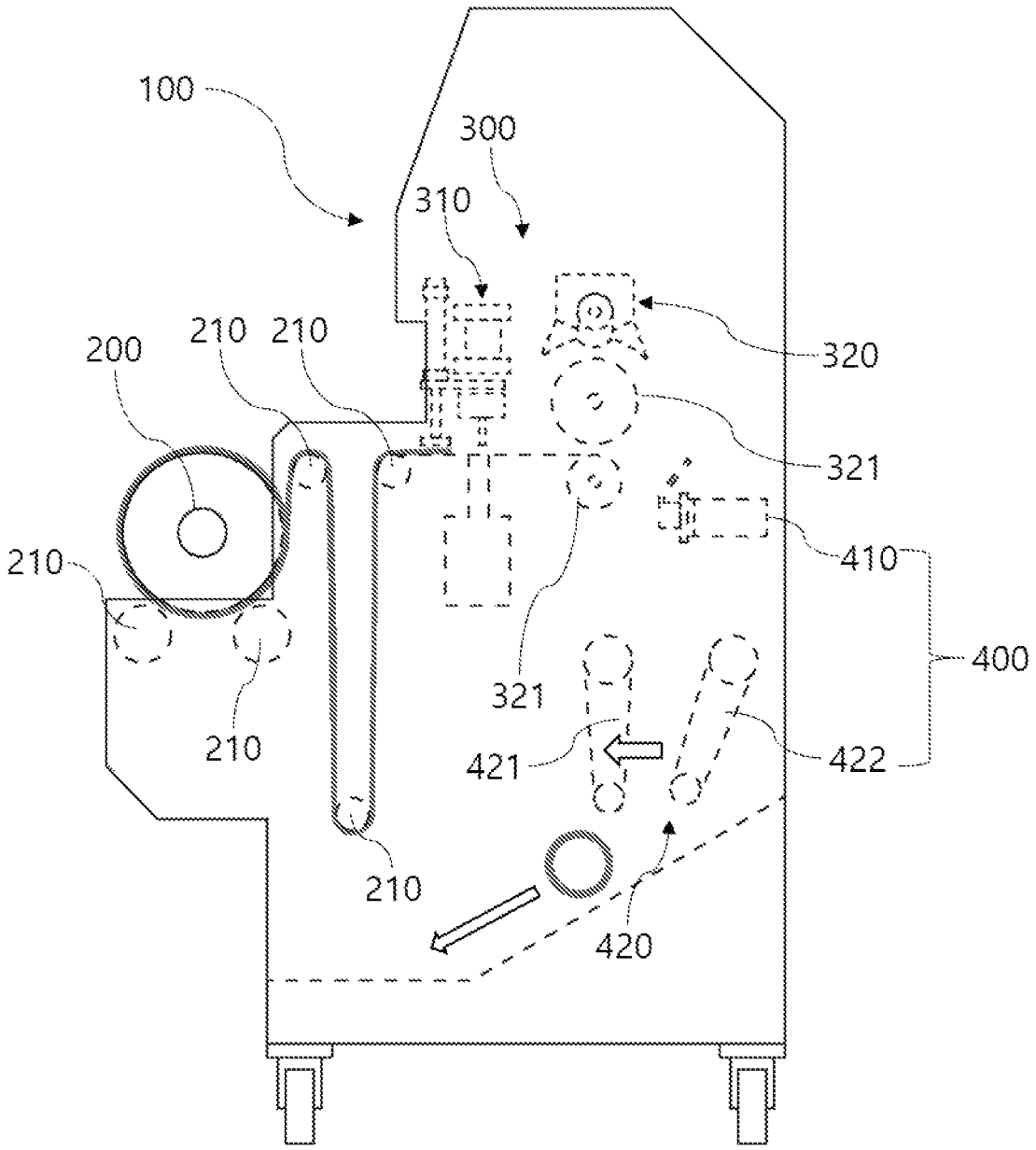
FIG. 7 is a view illustrating an operation sequence of the cutting apparatus for the roll zebra blind according to the preferred embodiment of the present invention.

Next, referring to FIG. 7, a gap occurs between the first rolling portion 421 and the second rolling portion 422 by rotating the first rolling portion 421 and then the unwound fabric is discharged to the outside of the main body portion 100 along an inclined surface of the lower portion.

As a result, the longitudinal cutting and the transverse cutting of the fabric may be performed in sequence to more enhance the precision of the cutting and the cutting of the fabric may be automatically performed to improve workability.

As described above, those skilled in the art will be able to understand that a technical configuration of the present invention can be easily executed in other detailed forms without changing the technical spirit or an essential feature thereof.

Therefore, the exemplary embodiments described as above are illustrative in all aspects and should be understood as not being restrictive and the scope of the present invention is represented by claims to be described below rather than the detailed description, and it is to be interpreted that the meaning and scope of the claims and all the changes or modified forms derived from the equivalents thereof come within the scope of the present invention.

What is claimed is:

1. A cutting apparatus for a roll zebra blind comprising:

a main body portion;

a mounting portion provided at one side of the main body portion to wind or unwind a fabric;

a cutting portion provided at one side of the main body portion to cut the fabric with a required length; and a discharge portion provided at one side of the main body portion to convey the fabric cut by the cutting portion to the outside, wherein the cutting portion includes:

first and second loading rollers mated with each other, which wind the fabric supplied from the mounting portion on the first loading roller provided with a bonding material having a bonding force for attaching an end of the fabric on the first loading roller, and which unwind the fabric cut by the cutting portion from the first loading roller toward the discharge portion;

a longitudinal cutting portion cutting the fabric, supplied from the mounting portion to the first and second loading rollers, in a longitudinal direction; and a transverse cutting portion cutting the fabric, supplied from the mounting portion to the first and second loading rollers, in a transverse direction, and wherein the discharge portion includes:

two rolling portions rotating independently and positioned under the first and second loading rollers, wherein the two rolling portions rotate in the same direction to receive and wind the fabric falling down from the first loading roller after being cut by the cutting portion; and a punch portion including a push rod, wherein the punch portion applies an external force to the fabric by pushing the push rod toward the fabric unwound and falling down from the first loading roller after being cut by the cutting portion so that the end of the fabric attached to the first loading roller by the bonding material is detached from the first loading roller by the push rod and the fabric falls down to be moved to the two rolling portions.

2. The cutting apparatus for a roll zebra blind of claim 1, wherein the mounting portion includes a laser portion emitting laser light indicating a point where the fabric is placed, and the laser portion guides an operator to check an original point of the fabric.

* * * * *